US006811806B2

(12) United States Patent
Droski

(10) Patent No.: US 6,811,806 B2
(45) Date of Patent: Nov. 2, 2004

(54) APPARATUS AND METHOD FOR SPRAY COATING SHEET MATERIAL

(76) Inventor: Michael Droski, 11837 Chandler Dr., Plymouth, MI (US) 48170

( * ) Notice: Subject to any disclaimer, the term of this patent is extended or adjusted under 35 U.S.C. 154(b) by 0 days.

(21) Appl. No.: 10/252,858

(22) Filed: Sep. 23, 2002

(65) Prior Publication Data

US 2004/0055532 A1 Mar. 25, 2004

(51) Int. Cl.[7] ..... B05D 3/14

(52) U.S. Cl. ..... 427/8; 118/300; 118/302; 118/315; 118/316; 118/696; 118/712; 427/421; 427/422

(58) Field of Search ..... 118/300, 302, 118/315, 316, 696, 712; 427/8, 421, 422

(56) References Cited

U.S. PATENT DOCUMENTS

| | | | |
|---|---|---|---|
| 3,974,674 | A | 8/1976 | Orozco et al. |
| 5,282,377 | A | 2/1994 | Illig et al. |
| 5,495,737 | A | 3/1996 | Graham |
| 5,801,128 | A | 9/1998 | Overstreet et al. |
| 6,146,699 | A | 11/2000 | Bonicel et al. |
| 6,299,690 | B1 | 10/2001 | Mongeon et al. |
| 6,318,139 | B1 | 11/2001 | Ishikura et al. |
| 2001/0028954 | A1 | 10/2001 | Groening et al. |

*Primary Examiner*—Bernard Pianalto
(74) *Attorney, Agent, or Firm*—Young & Basile, P.C.

(57) ABSTRACT

An apparatus and method for spraying an atomized liquid compound onto a sheet material traveling along a material coating process line. The apparatus and method heats and mixes a liquid compound then atomizes and sprays the atomized liquid compound to coat the sheet material. The apparatus and method selectively provide an atomized liquid compound which improves coating, dries quickly on the sheet material, and increases process line productivity.

32 Claims, 7 Drawing Sheets

APPARATUS AND METHOD FOR SPRAY COATING SHEET MATERIAL

FIELD OF THE INVENTION

The present apparatus and method relates to spray coating sheet materials and, more particularly, to an apparatus and method for spray coating sheet material with a heated and atomized liquid compound to decrease coating drying time, improve coating quality and increase production efficiency.

BACKGROUND OF THE INVENTION

Application of spray coatings to sheet materials, such as forming lubricants sprayed onto sheet metal or coiled steel, that undergo drawing operations exposing the sheet and lubricant to extreme pressures are known in the art. The application of lubricants suitable for sheet metals varies on the forming process used, material to be coated and the properties of the lubricant itself. It has long been known to apply common oils and greases to lubricate the sheet to facilitate drawing or forming and to prevent unwanted thinning or tearing of the material. In the case of ferrous materials, the greases and oils further acted to prevent premature corrosion. These common greases or oils, however, were difficult to remove since such solvents required special handling and storage.

During World War II, oils and greases became difficult to obtain, and it was discovered that borax or soap-based lubricants provided the necessary lubrication without having to remove the lubricant prior to subsequent coating of the sheet material with primer or paint. Such soap-based lubricants were dissolvable in water, rolled or sprayed on the sheet material, and eventually dried on the sheet once the water evaporated. The soap-based lubricants, although applied mixed with water, became known as "dry" lubricants as the lubricant is dry at the time of forming the sheet metal. Progression of the sheet metal along the processing line was dependent on the typically lengthy drying time of the lubricant which required reduced line speeds. Due to the need to keep the process line moving, a significant length of floor space was needed to ensure drying of the lubricant prior to further processing.

Prior methods for applying dry lubricants were typically conducted by spraying an excessive amount of a lubricant/water mixture onto the sheet material. In order to obtain the recommended or desired coating weight per square foot of material, prior roll coating processes used rubber rollers on the top and bottom surfaces of the sheet metal to squeeze or press the undesired quantity and weight of the sprayed-on lubricant from the sheet material. Such prior art processes provided full coverage of the sheet metal but had numerous disadvantages.

The prior roll coating processes are problematic in that dry lubricants are very costly, and the prior art methods used excessive amounts of dry lubricant, much of which was wasted through the spraying and squeezing process and often producing uneven coating weight on the material. The prior art processes were further problematic in that the rubber rollers used to squeeze off excess lubricant were subject to wear requiring reconditioning or replacement and added to uneven coating weight of the dry lubricant. The prior art processes were further problematic in that they slowed the process line speed requiring significant space in the process line and time for the water to sufficiently evaporate from the sheet material. The prior art processes were further subject to significant down time of the process line due to replacement of worn rollers and the necessity to change the rollers between coating production runs.

Consequently, it would be desirable to provide a spray coating apparatus and method that improved the problematic conditions in the prior art, that is efficient in applying a desired coating weight, that improves the consistency of the coating, that reduces clogging of the apparatus, that facilitates an increase in productivity through an increase in process line speed, that reduces the space required for the apparatus in the process line and space needed for drying the coating, and that is simple and relatively inexpensive to produce and operate.

SUMMARY OF THE INVENTION

The spray coating apparatus of the present invention includes a base having a batch tank positioned thereon which is used to contain and mix water with a water soluble material to form a liquid compound. The apparatus includes at least one spray control valve in fluid communication with the batch tank to selectively dispense the liquid compound from the batch tank to at least one spray nozzle. The apparatus further includes at least one spray nozzle which is adapted to receive the liquid compound from the control valve and receive a supply of heated gas which is mixed with the liquid compound in the nozzle to heat and begin atomizing the compound and spray the atomized compound onto the sheet material.

In another embodiment of the invention, the apparatus further includes a spray header positioned along the coating line for the sheet material in spaced relation to the base. The spray header includes a plurality of spray nozzles adapted to receive and communicate with the liquid compound and the heated gas.

In another embodiment of the invention, steam is used as the heated gas that is placed in communication with the liquid compound.

In yet another embodiment of the invention, a process tank is positioned on the base in fluid communication with the batch tank to hold a reserve of mixed liquid lubrication compound to be sent to the spray control valve.

In an additional embodiment, a user control terminal is positioned on the base for monitoring and controlling the mixing of the liquid lubrication compound and the spraying of the atomized lubricant on the sheet material.

The present invention also provides a method for applying a spray coating to sheet material including the steps of adding a water soluble material to a quantity of water in a batch tank and mixing the material with water in the batch tank to form a liquid compound. The liquid compound is selectively dispensed under pressure to at least one spray nozzle. The liquid compound is then atomized and sprayed onto the sheet material traveling along a coating line.

In another embodiment of the inventive method, the water and liquid compound in the batch tank are heated in the batch tank.

In another embodiment, the spray nozzles are adapted to receive and communicate the liquid compound and a heated gas to further heat the liquid compound and begin atomizing the liquid compound.

In yet another embodiment of the inventive method, a process tank is provided in fluid communication with the batch tank to store a reserve of liquid lubrication compound to be selectively dispensed to the spray nozzle.

In an additional embodiment of the inventive method, a plurality of spray control valves and spray nozzles are provided for dispensing the liquid lubrication compound through selected valves to selected nozzles to coat the material sheet.

In even another embodiment of the inventive method, a heated gas is supplied to a jacket in the spray nozzle to heat and deter clogging of the nozzle.

In a further embodiment of the inventive method, a user control terminal is provided to control and monitor the mixing and spraying of the atomized lubrication compound to the sheet material along the coating line.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
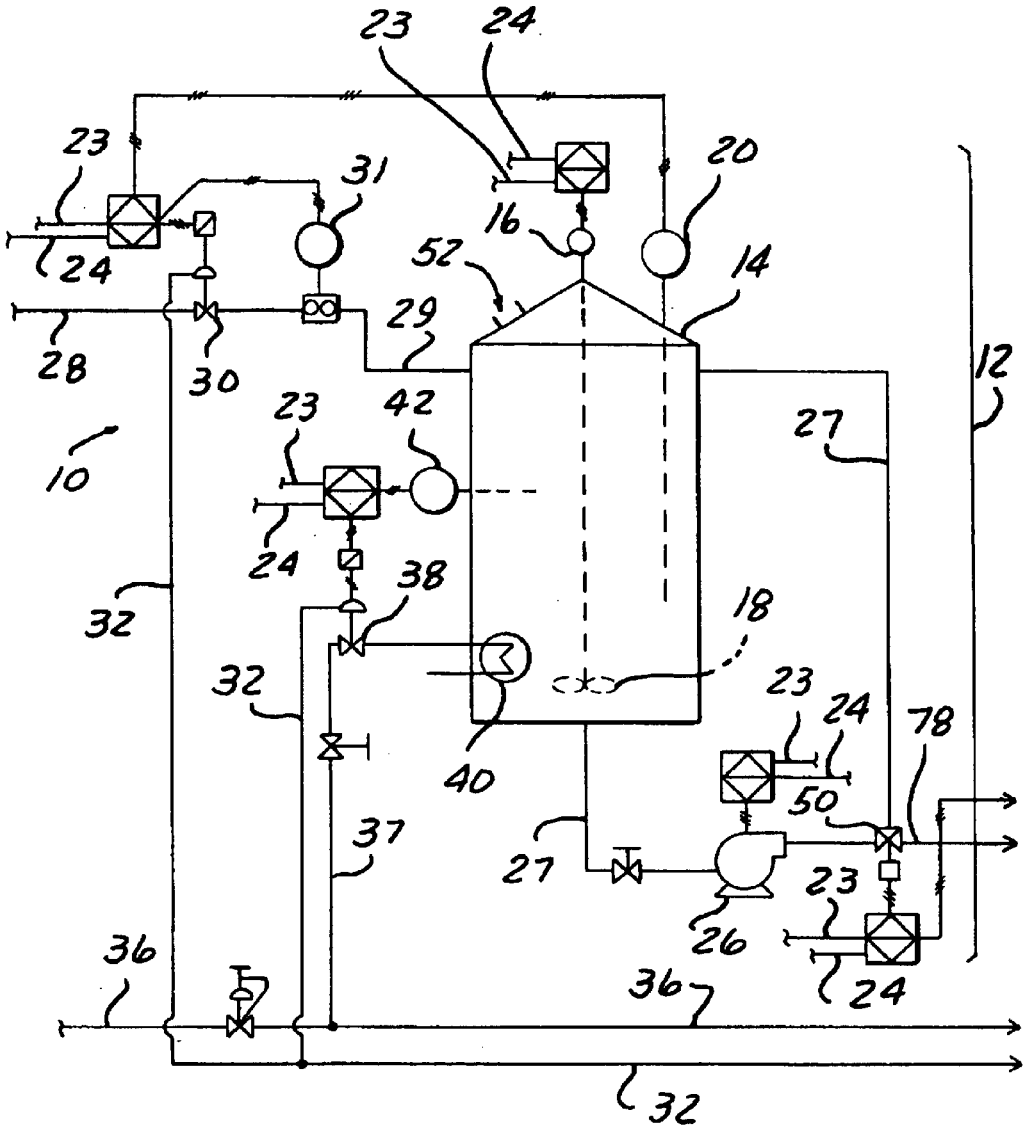
FIG. 1 is a partial schematic view of the apparatus and method including the batch mixing assembly including the batch tank recirculation components.
Figure 7:
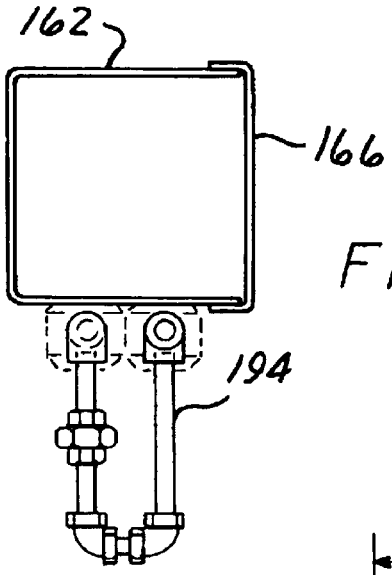
FIG. 7 is a sectional view taken along line A—A in FIG. 4.
Figure 8:
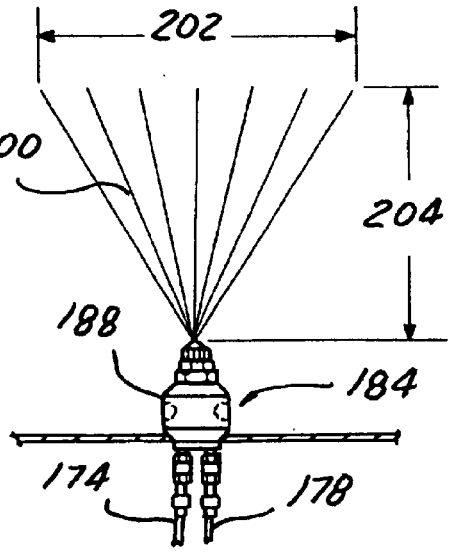
FIG. 8 is an enlarged view of an area circled in FIG. 4.
Figure 9:
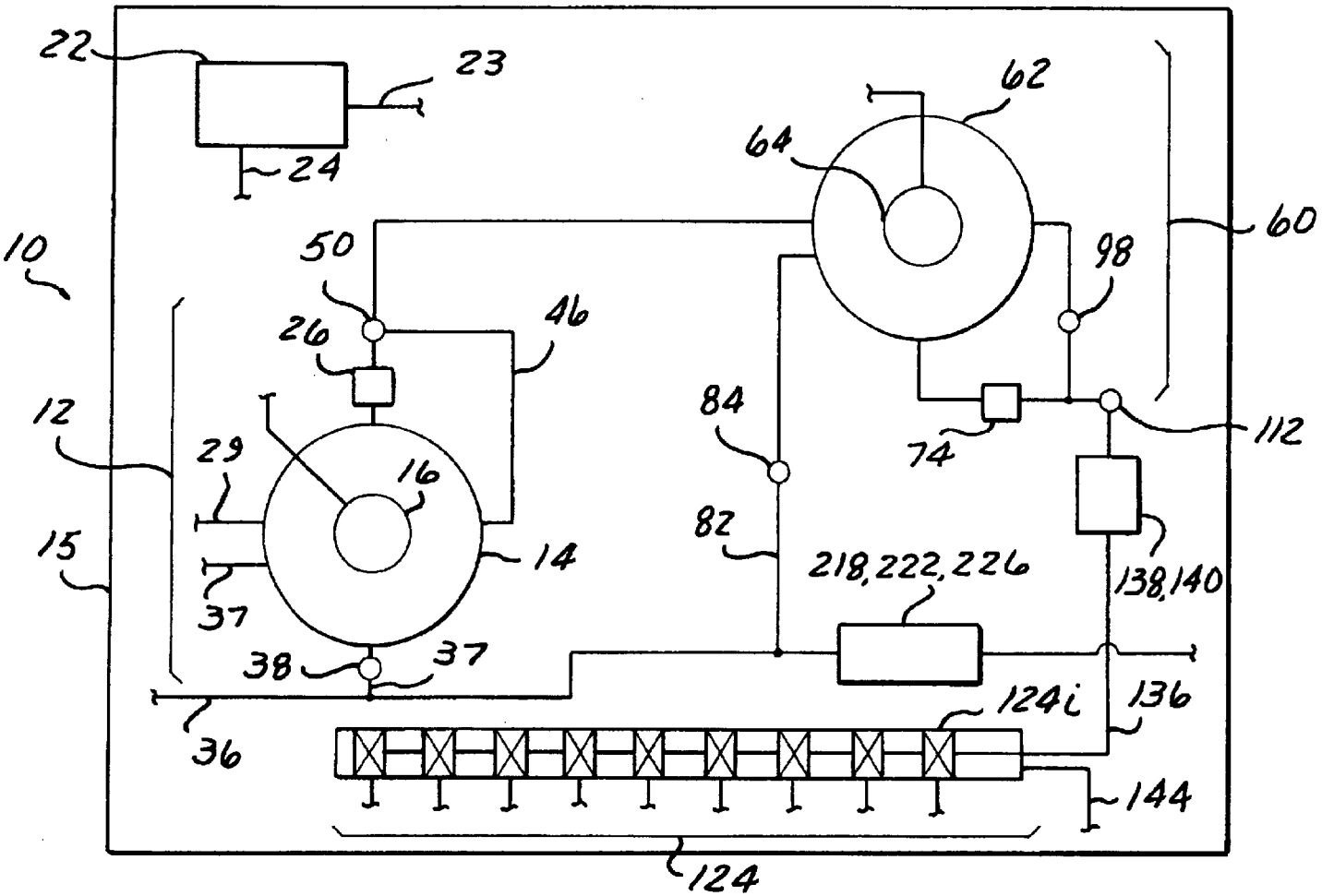
FIG. 9 is a partial schematic of the apparatus and method of the present invention showing the base, batch mixing and process mixing assemblies, user control terminal and spray control valves.

Referring to FIGS. 1–10, an apparatus and method 10 for applying a spray coating to sheet material is illustrated. Referring specifically to FIGS. 1 and 9, the apparatus 10 includes a batch mixing assembly 12 including a batch tank 14 positioned on a rigid base 15 as shown in FIG. 9. Batch tank 14 is a cylindrically-shaped, vertically oriented holding tank having a capacity of approximately 200 gallons and base 15 is a rectangularly-shaped rigid steel plate suitable for moving by a forklift or overhead crane.

Batch mixing assembly 12 includes a first mixer 16 positioned above batch tank 14 and includes a shaft 17 and first impeller 18 extending downwardly into batch tank 14 as best seen in FIG. 1. Batch mixing assembly 12 further includes a batch liquid level sensor 20 which extends downwardly into batch tank 14.

Batch mixing assembly 12 further includes a batch pump 26 which is in fluid communication with the batch tank 14 through batch recirculation line 27.

As best seen in FIG. 1, a supply of water is provided under pressure to batch tank 14 through water line 28. The flow of water is controlled by an inlet water valve 30. Inlet water valve 30 is a pneumatically operated control valve receiving air under pressure through air line 32 from an air header 128 shown in FIG. 3. Inlet water valve 30 is operated and monitored by signals sent to and received from a user control terminal 22 as seen in FIG. 9 through control signal input line 23 and control signal output line 24. Control terminal 22 is a personal computer, not shown, having software adapted to the apparatus and process and a touch-screen user interface as described below.

Batch mixing assembly 12 further includes a heating element 40 positioned inside batch tank 14 as seen in FIG. 1. The apparatus includes a heating element 40 which is a coil heated by a heated gas, most preferably steam, supplied under pressure through batch steam lines 36 and 37. The heating element 40 is positioned at the 45 gallon point in the 200 gallon capacity batch tank 14. Steam for heating element 40 is controlled by a batch steam control valve 38 which is pneumatically operated through connection to the pressurized air line 32. Steam control valve 38 is controlled and operated by the user control terminal 22 through signal input 23 and signal output 24 lines as previously described. Batch steam control valve 38 is electronically connected to a batch tank temperature sensor 42 which protrudes into batch tank 14 to monitor the temperature of the liquid contents in batch tank 14 and to transmit the temperature to the user control terminal 22 which in turn signals steam control valve 38 to open and close as needed. In an alternate aspect, the heated gas is heated air instead of steam.

Batch mixing assembly 12 further includes a three-way batch solenoid valve 50 positioned between batch tank 14 and batch pump 26 in batch recirculation line 27 as best seen in FIG. 1. Pneumatically operated batch solenoid valve 50 is controlled and operated by user control terminal 22. Batch mixing assembly 12 also includes an inlet port 52 in batch tank 14 for adding a water soluble material in the form of liquid, powder, pellets or other form of media to the batch tank 14 to be mixed with the water to form a liquid compound.

Figure 2:
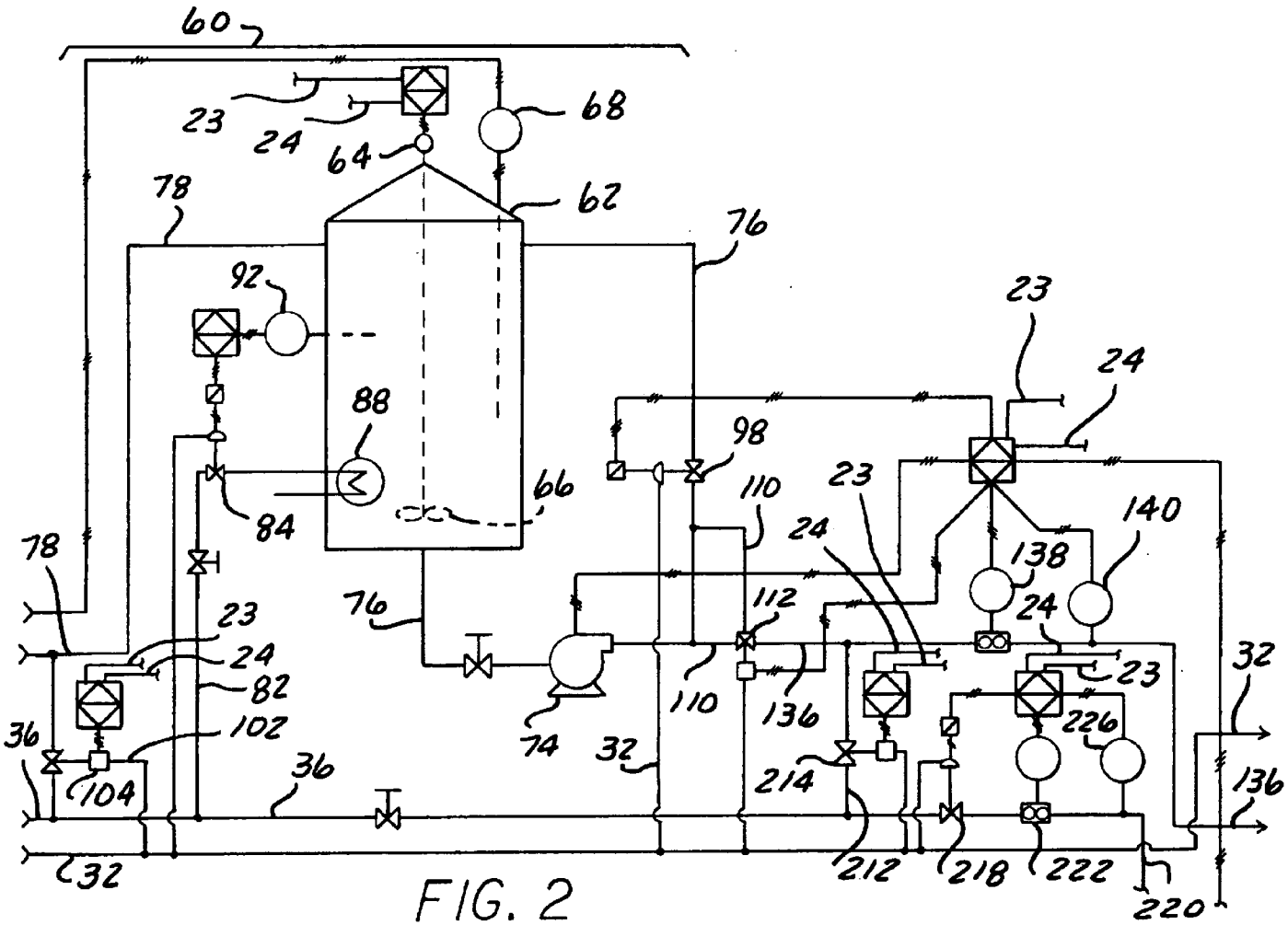
FIG. 2 is a partial schematic view of the apparatus and method including the process mixing assembly including the process tank recirculation components and monitoring sensors.

The spray coating apparatus and method preferably further includes a process mixing assembly 60 as best seen in FIGS. 2 and 9. The process mixing assembly 60 stores a reserve of heated and mixed liquid compound that stands ready for disbursement while a new batch of liquid compound is heated and mixed. The reserve of liquid compound provides a continuous or almost continuous supply of liquid compound to support the needs of the coating line. Where such continuous supply of compound is not needed or downtime is not critical, the batch tank assembly 12 may be employed without the need for process mixing assembly 60.

Process mixing assembly 60 includes a process tank 62 similar in configuration and capacity as batch tank 14. Process mixing assembly 60 further includes a second mixer 64 extending downwardly into process tank 62 and includes a second impeller 66 for mixing the contents of the process tank 62. Process mixing assembly 60 further includes a process tank level sensor 68 extending downwardly into process tank 62 for monitoring the level of liquid in the tank. Process mixing assembly 60 further includes a process pump 74 in fluid communication with process tank 62 through process recirculation line 76. Process mixing assembly 60 also includes a process tank inlet line 78 which is in fluid communication with batch solenoid control valve 50 to permit flow of fluid from batch tank 14 to process tank 62 through opening of batch solenoid valve 50 on signal from the user control terminal 22.

The preferred process mixing assembly 60 further includes a heating element 88 positioned inside process tank 62 similar in construction, position and function as heating element 40 in batch tank 14. Heating element 88 is preferably heated by steam provided under pressure from steam line 36 through process steam inlet line 82 and process tank steam control valve 84. Process tank steam control valve 84 is pneumatically operated and controlled by user terminal 22 and is electronically connected to process tank temperature sensor 92 as previously described for valve 38 and sensor 42 in batch tank 14.

Process mixing assembly 60 further includes a process recirculation valve 98 positioned between process tank 62 and process pump 74 and is pneumatically controlled and operated by user control terminal 22 to permit the flow of fluid from process tank 62 through recirculation line 76.

Process mixing assembly 60 further includes a first steam purge line 102 in gaseous communication with steam line 36. A first steam purge solenoid valve 104 is positioned in steam purge line 102 to selectively permit the passage of steam to and through process tank inlet line 78 to flush the line with steam to disperse sedimentation and prevent clogging as further described below. In an alternate aspect, heated air is used instead of steam.

Process mixing assembly 60 further includes a process tank outlet 110 and a process three-way solenoid control valve 112 in fluid communication with process recirculation line 76. The solenoid valve 112 is pneumatically operated and controlled by user terminal 22 in a similar fashion as batch solenoid control valve 50 as previously described. Solenoid valve 112 selectively permits the passage of fluid from process tank 62 to the remainder of the system as described immediately below.

Figure 3:
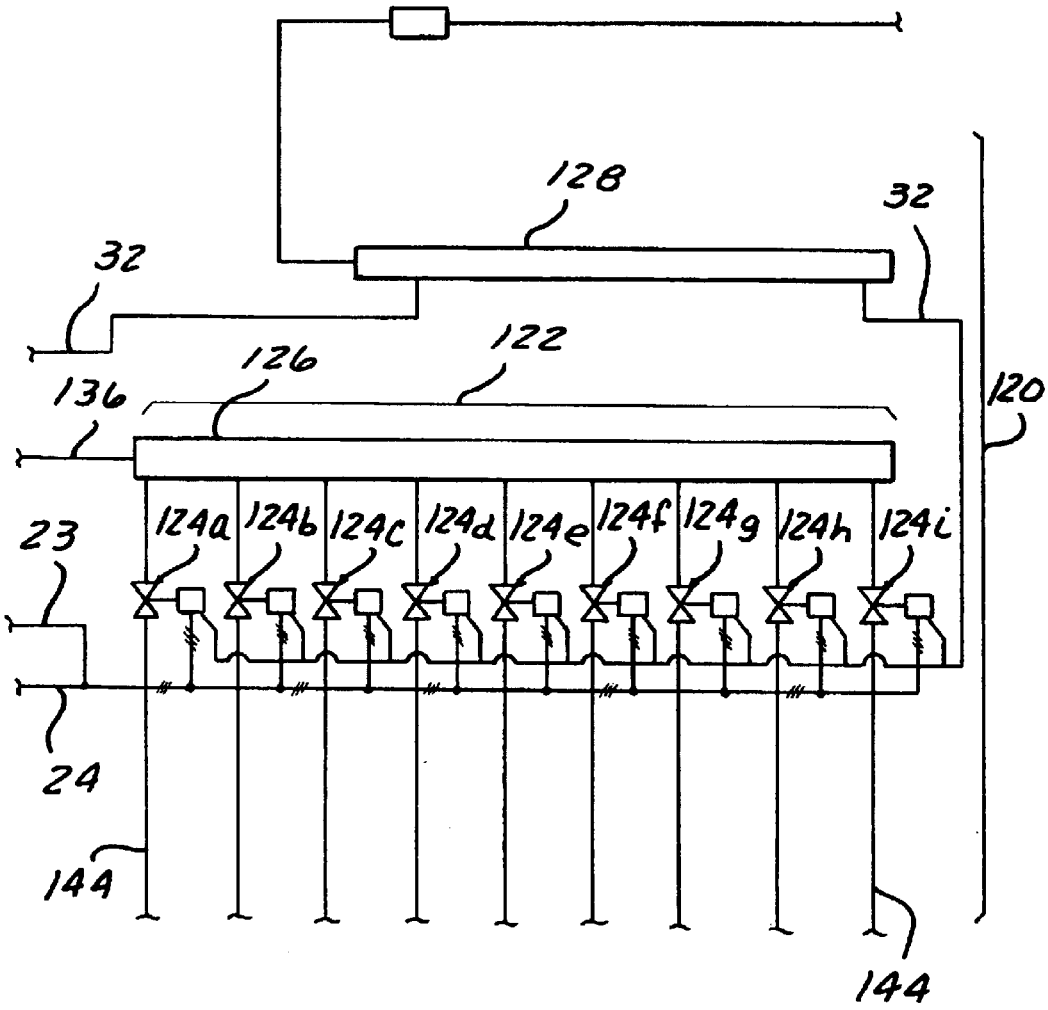
FIG. 3 is a partial schematic of the apparatus and method including the flow control valves for the spray header device.

The spray coating apparatus and method 10 further includes at least one spray control valve 124, and most preferably nine spray control valves 124(*a*)–(*i*) as best seen in FIG. 3. In a preferred aspect of the invention, spray control valves 124 are positioned in adjacent proximity to spray header 150 discussed below. For simplicity of illustration, in an alternate aspect, spray control valves 124 are positioned on base 15 as shown in FIG. 9. Spray control valves 124 are positioned in fluid communication with process tank outlet 110 through process tank solenoid control valve 112 and through spray valve inlet line 136. Spray valve inlet line 136 permits the selective passage of fluid to the spray control valves 124 through a spray valve manifold 126. The spray control valves 124 are pneumatically operated and controlled by user control terminal 22 through the pressurized air header 128 and air line 32. Spray control valves 124 further include spray control valve outlet lines 144 having one outlet line 144 for each spray control valve 124(*a*)–(*i*).

Figure 4:
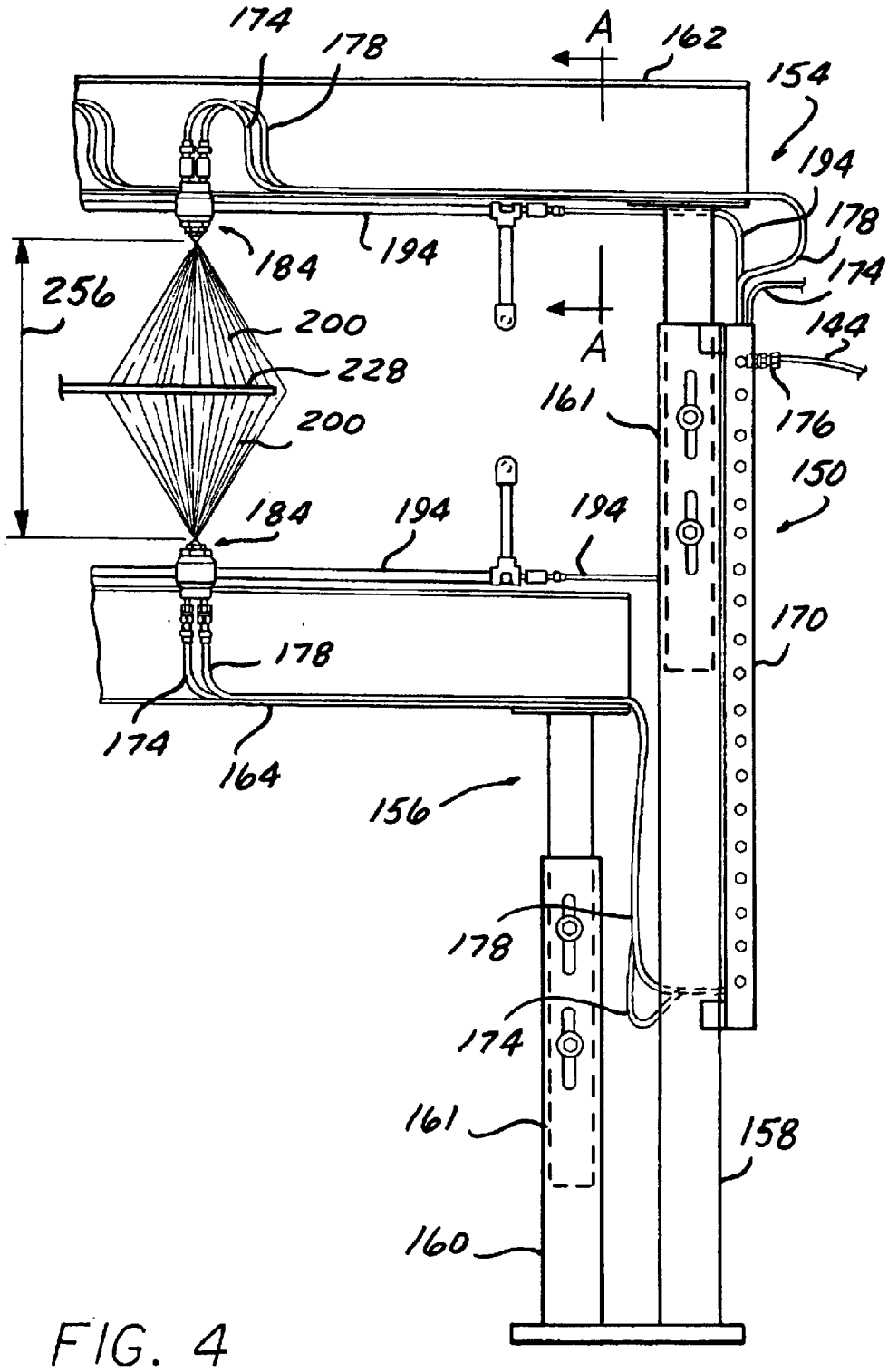
FIG. 4 is a partial front elevational view of the spray header.

The spray coating apparatus and method 10 further include a spray header 150 as best seen in FIGS. 4 through 8 and 10. Spray header 150 includes an upper header frame 154 and a lower header frame 156 as best seen in FIG. 4.

Upper frame 154 includes upper support columns 158 and an upper beam 162.

Lower frame 156 includes lower support columns 160 and a lower beam 164. Upper 158 and lower 160 support columns are vertically adjustable through elbows 161 to accommodate different heights of the coating line 234 and sheet material to be coated. Upper and lower beams 162, 164, respectively, include a cover 166 to close the open surface of the beams. In a preferred aspect, 3×3 inch square steel tubing is used for the lower portion and 2½×2½ inch square steel tubing for the telescoping upper portion of upper 158 and lower 160 column supports. Upper 162 and lower 164 beams are made from thin gage steel in a C-shaped section having a corrosion resistant coating. Spray header 150 is positioned in spaced, but adjacent, relationship to base 15 while remaining in fluid and gaseous communication with process mixing assembly 60 and steam line 36. It is contemplated that to aid in space reduction and further portability, spray header 150 may be attached to base 15.

Figure 5:
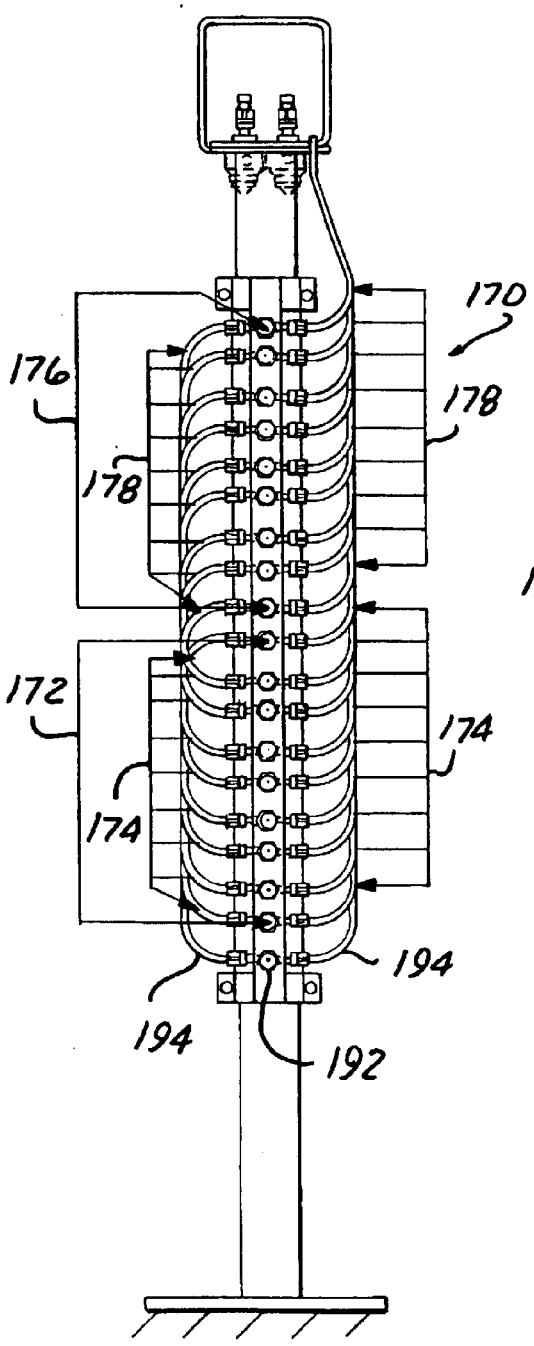
FIG. 5 is a side elevational view of the spray header device shown in FIG. 4.
Figure 10:
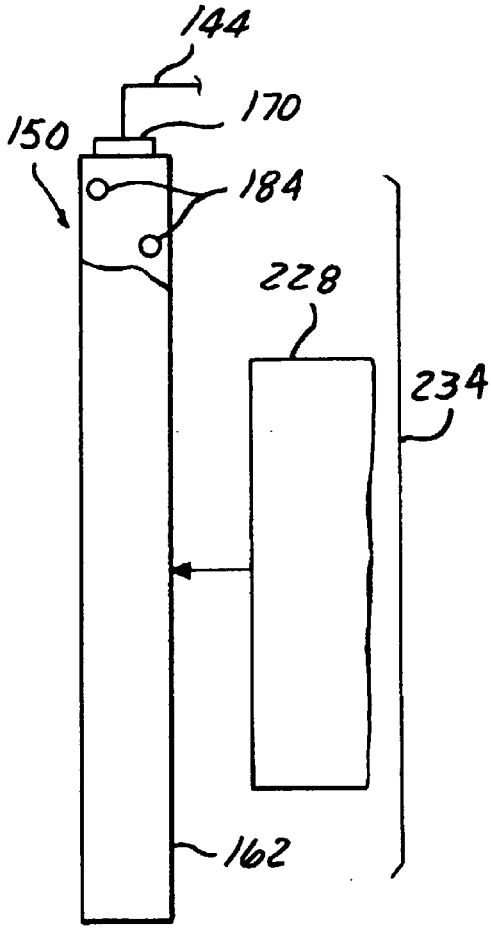
FIG. 10 is a partial, cut-away schematic of the apparatus and method showing the spray header, coating line and material sheet.

Spray header 150 further includes a spray manifold 170 attached to one of the upper support columns 158 as best seen in FIGS. 4 and 5. Spray manifold 170 includes nine manifold steam inlet receptacles 172 and 18 manifold steam outlet lines 174. Steam inlet receptacles 172 receive a heated gas, most preferably steam, under pressure from nine steam lines, not shown, in gaseous communication with steam line 36. In an alternate aspect, heated air is used instead of steam for the heated gas. Spray manifold 170 further includes nine liquid compound fluid inlet receptacles 176 and 18 manifold liquid lubrication outlet lines 178, nine of the fluid outlet lines 178 being routed to upper beam 162 and nine fluid lines 178 routed to lower beam 164. In similar fashion, nine of the manifold steam outlet lines 174 are routed to upper beam 162 and nine are routed to lower beam 164. Manifold 170 further includes a nozzle jacket steam inlet receptacle 192 and two nozzle jacket steam outlet lines 194, one line 194 being routed to upper beam 162 and one routed to lower beam 164 as seen in FIG. 4. Nozzle jacket steam inlet receptacle 192 is most preferably in gaseous communication with steam line 36. In an alternate aspect, heated air is used instead of steam as the heated gas.

Figure 6:
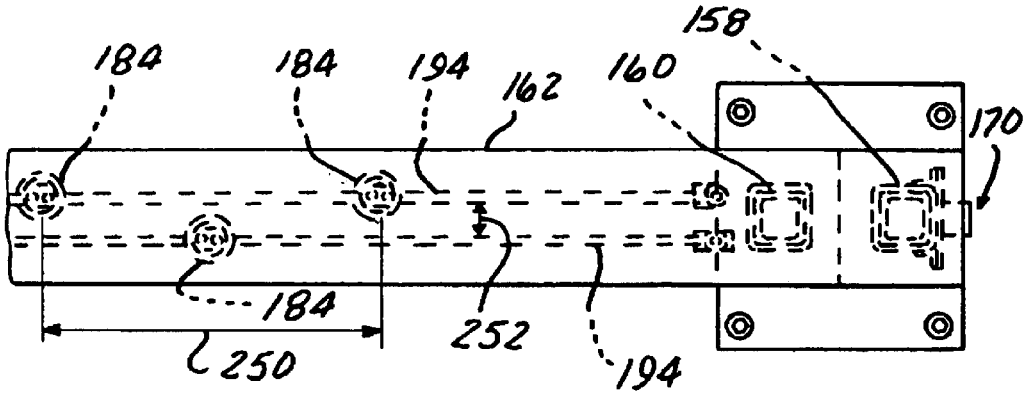
FIG. 6 is a partial plan view of the spray header device shown in FIG. 4.

Spray header 150 further includes at least one spray nozzle 184 and most preferably a total of 18 spray nozzles 184 spaced in relation to one another as best seen in FIGS. 4–6. Nine nozzles 184 are spaced in longitudinal and lateral orientation from one another across upper beam 162 and lower beam 164 as best seen in FIGS. 4 and 6. A row of five nozzles placed at a distance 250 apart are separated by a distance 252 from a second row of four nozzles spaced at a distance 250 apart from one another for spray coating sheet material 228. The distance 250 between nozzles 184 is approximately 16 inches apart on center of each nozzle and the distance 252 between rows is approximately two inches.

In a most preferred embodiment, each nozzle 184 is adapted to receive a steam outlet line 174 and a liquid compound outlet line 178 from the manifold 170. Each nozzle 184 also includes a spray nozzle jacket which is adapted to receive a steam outlet line 194 from manifold 170 as best seen in FIGS. 4, 7 and 8. Each nozzle 184 is adapted to place liquid from manifold liquid outlet lines 178 in direct communication with a heated gas, most preferably steam, from manifold steam outlet lines 174 to further heat and begin atomizing the liquid compound. In an alternate aspect, heated air is used instead of steam for the heated gas for either or both atomizing the liquid compound and heating the nozzle jacket. The at least partially atomized lubrication compound is forced to exit nozzle 184 under pressure as an atomized spray 200 having a spray width 202 and length 204 as best seen in FIG. 8.

Spray header 150 is positioned along the sheet material coating line 234 and is adapted to receive sheet material 228 between the upper beam 162 and lower beam 164 passing between the spray nozzles 184 placing an upper and a lower surface of the sheet material, not shown, in spray communication with spray nozzles 184 suitable to provide a desired coating weight on the upper and lower surface of sheet material 228. Sheet material 228 is supported by a conveyor, not shown, traveling along coating line 234 and is interrupted for a brief length prior to and through spray header 150 and recommences to support and carry the sheeting material for drying and subsequent processing.

Referring to FIG. 2, spray coating apparatus and method 10 further includes a second steam purge line 212 in gaseous communication with steam line 36 to flush the lines or path the liquid lubrication compound follows between the process solenoid valve 112 and spray nozzles 184. The passage of steam through second purge line 212 into spray inlet line 136 is controlled by a second steam purge solenoid valve 214 in gaseous communication with spray valve inlet line 136. Steam purge solenoid valve 214 is pneumatically operated from pressurized air from air line 32 and controlled by signals from user control terminal 22. Spray coating system 10 further includes a third steam purge valve 218 in gaseous communication with steam line 36 to selectively permit the flow of steam from steam line 36 to the steam manifold inlet receptacles 172 through steam purge line 220. Valve 218 is pneumatically controlled through pressurized air from air line 32 and controlled by signals from user control terminal 22. Steam purge line 220 further includes a steam flow sensor 222 and pressure sensor 226 which monitors and signals user control terminal 22 for display to the user. In an alternate aspect, heated air is used instead of steam.

Referring to FIGS. 1 through 10, the inventive method of the present invention is illustrated. Prior to filling and initiating spraying by the spray coating apparatus 10, several operator inputs or variables must be defined. The user control terminal 22 includes a computer display monitor, not shown, having an operator interface touch screen (HMI). The operator interface includes an initial Setup Screen or mode programmed in the user control terminal 22 computer software, not shown, for input of the linear speed of the mill line which is the speed the sheet material 228 will be traveling along the coating line 234. At this Setup Screen, the width of the mill strip or sheet material 228 is also manually entered. It is contemplated that additional sensors, not shown, could operate to automatically detect and monitor the width of sheet 228 and monitor the linear speed of the sheet material 228 traveling along coating line 234 and provide representative signals to user control terminal 22 versus manually entering the speed and width as described above. In the event sensors are available and are automatically monitoring line speed and material width, an Automatic feature or mode on the operator interface screen could be employed versus a manual feature or mode whereby the operator manually inputs the information as described above.

In order to initiate the filling of the spray coating apparatus 10, a Tank Setup feature or mode is accessed by a user on the user interface. At the Tank Setup screen, the user can manually set a high liquid level and low liquid level for the batch tank 14. Using a 200 gallon batch tank, a high level set point of 150 gallons and a low level set point of 45 gallons is input or established as a default in the control terminal 22 program.

On input of the information under the Tank Setup screen, the user proceeds to a Batch Mixing Tank screen displayed on the user interface. On the Batch Mixing Tank screen, an option to select a Fill To 50% button is pushed or activated to initiate the flow of water under pressure through water line 28. The user control terminal provides a signal to automatically open pneumatically operated water inlet valve 30 which permits flow of water into batch tank 14. Once the level of water in batch tank 14 achieves the low liquid level amount of 45 gallons, user control terminal 22 sends a signal to open batch steam inlet valve 38 permitting a heated gas, most preferably steam, to flow into batch heating element 40 to heat the water while the water continues to rise. In an alternate aspect, heated air is used instead of steam for the heated gas. At approximately this point, user control terminal 22 will signal and start the first mixer 16 and place the batch pump 26 in a recirculation mode. In this mode, batch pump 26 will draw water from a lower portion of batch tank 14 and force the water through batch recirculation line 27 for deposit of the warming water into an upper portion of batch tank 14 as seen in FIG. 1. The mixer 16 will provide agitation to mix and uniformly heat the water.

Once the batch tank 14 is filled to one-half of the desired high liquid level point of 150 gallons and reaches a temperature of approximately 180° F. as measured by batch temperature sensor 42, an indicator visible on the interface screen of the user control terminal 22 to Add Powder will be enabled permitting the operator to add a necessary amount of water soluble material to the heated water. In one embodiment, the material is a water soluble forming lubricant for sheet metal. In a preferred embodiment, a borax-based "dry" sheet metal drawing lubricant, as previously described, is added to the heated water in powdered form through inlet 52 in batch tank 14 to form a liquid lubrication compound. For exemplary purposes only, a suitable borax-based, water-soluble dry drawing lubricant is T.C. 1800-3 manufactured by Tru-Chem Co., Inc. of Columbus, Ohio. It is contemplated that other borax-based, water-soluble dry lubricants and other water soluble materials, in powdered, liquid, flaked, pelletized, granular, or other forms, may be used without departing from the present invention.

The amount of water soluble material added to the heated water in batch tank 14 is dependent on several factors including: the width of the sheet material 228, the line or linear process speed of sheet material 228 that passes spray header 150 in a given period of time and the desired weight of the coating to be applied to the sheet material. It has been determined that 24.5 oz. of T.C. 1800-3 to one gallon of water will achieve a coating weight of approximately 300 mg/sq. ft. Once the water soluble material is automatically or manually added to batch tank 14, the user acknowledges that the powder has been added by pressing the Add Powder acknowledgment button or prompt on the user interface of user control terminal 22.

To continue the process, the operator next activates a Fill To 100% button visible on the Batch Mixing Tank screen on the user interface which signals and re-opens water inlet valve 30 permitting additional water to enter the batch tank 14. Once sufficient water is added to batch tank 14 to reach the desired high liquid level set point of 150 gallons, the user control terminal signals and closes water inlet valve 30 preventing additional water from entering the batch tank.

In one embodiment, when batch tank 14 is filled to 150 gallons, first mixer 16 will continue mixing the liquid lubrication compound for 30 minutes while batch heating element 40 maintains the liquid lubrication compound at approximately 180° F. Throughout this time, batch pump 26 remains in a recirculation mode to recirculate the liquid lubrication compound through recirculation line 27 to deter sedimentation and clogging in the pump and recirculation line. Following the preferred 30 thirty minutes mixing time period at 180° F., a Batch Ready prompt will be displaced on the user interface on the user control terminal 22. The liquid lubrication compound is now ready for distribution from the batch tank to the spray control valves 124.

In another embodiment of the inventive method, a process mixing assembly 60 is placed on base 15 in liquid communication between the batch tank 14 and the spray control valves 124. The process mixing assembly 60 permits a reserve of heated and mixed liquid lubrication compound to be stored while the batch tank 14 is refilled, the water is heated, and the lubrication is mixed while the process mixing assembly 60 stands ready or supports active spraying. The reserve of prepared liquid lubrication provides for a near constant flow of liquid lubrication compound to the spray header 150 to support the coating line. As explained, if a reserve is not required, the liquid lubrication compound may be dispensed directly from the batch tank 14.

In yet another embodiment of the inventive method, batch pump 26 is taken off the recirculation mode by the user control terminal 22 and the three way batch solenoid control valve 50 is opened to permit batch pump 26 to force liquid lubrication compound from batch tank 14 along process tank inlet 78 to an upper portion of process tank 62 to begin filling the process tank as seen in FIG. 2. Once the liquid lubrication compound reaches the predetermined lower liquid level of 45 gallons as measured by the process liquid level sensor 68, process tank heating element 88 will be heated through the opening of process steam control valve 84 by the user control terminal 22. The contents of batch tank 14 will be pumped into process tank 62 until the liquid level in batch tank 14 reaches the predetermined low level point of 45 gallons effectively transferring 105 gallons to the process tank. It is desired that the contents of batch tank 14 not fall below the 45 gallon liquid low level mark which would fall below the position of batch heating element 40 and allow the liquid lubrication compound in batch tank 14 to begin to cool. In a similar fashion, it is understood that subsequent batches of liquid lubrication compound from batch tank 14 to batch tank 62 will raise the contents of process tank 62 to the desired predetermined high liquid level mark of 150 gallons as the transfer of 105 gallons will be added to the 45 gallons already in process tank 62 left from the prior batch.

Once the transfer to batch tank 14 to process tank 62 has been made and batch tank 14 is at the low liquid level of 45 gallons, the user control terminal 22 will signal and close the batch solenoid valve 50 and place batch pump 26 and process pump 74 in a recirculation mode to deter sedimentation and clogging of the liquid lubrication compound. While batch solenoid valve 50 is closed preventing additional liquid lubrication compound from passing to the process tank 62, the process tank inlet line 78 is flushed with heated gas, most preferably steam, to clear the line and prevent sedimentation and clogging of the line. This accomplished through opening of the first steam purge solenoid valve 104 as best seen in FIG. 2 to allow the steam under pressure to pass through first steam purge line 102 into process tank inlet line 78 purging the steam and residual liquid lubrication compound into process tank 62. Flushing of process inlet line 78 continues for approximately 15 minutes. In an alternate aspect, heated air is used instead of steam for the heated gas.

If additional liquid lubrication compound is required to support the coating line 234 beyond the reserve in process tank 62, the operator can again initiate filling and mixing of the batch tank through the Batch Tank screen through the method previously described. Upon depleting the liquid lubrication compound in process tank 62 to the predetermined low liquid level line of 45 gallons, user control terminal 22 halts recirculation mode of batch pump 26, opens batch solenoid valve 50 and batch pump 26 again transfers the 105 gallons of heated and mixed liquid lubrication compound from batch tank 14 to process tank 62 as previously described.

On achieving the predetermined high liquid level mark of 150 gallons in process tank 62 and the preferred temperature of 180° F. is achieved through monitoring by process tank temperature sensor 92, dispensing of the liquid lubrication compound to the spray control valves 124 is initiated by either of two ways: Automatic or Manual Mode. In the Automatic Mode, once the system prerequisites of liquid level and temperature are met, user control terminal 22 halts recirculation mode of process pump 74, opens process recirculation valve 98 and opens three-way process solenoid valve 112. User control terminal 22 automatically activates the process pump 74 to begin pumping the heated liquid lubrication compound to the spray control valves 124. A visual indicator will be displayed on the user interface indicating the sprays are On. In the Manual Mode, the user will receive a prompt through the user interface that the system is ready to initiate spraying. The user then activates a Spray On prompt or button. Once the sprayers are placed in an On position by either automatic or manual mode, the liquid lubrication compound will be permitted to pass from the process tank 62 to the spray control valves 124.

The liquid lubrication compound will be supplied under pressure by process pump 74 to at least one, and most preferably nine, pneumatically controlled spray control valves 124(*a*)–(*i*) through spray valve inlet line 136 to a spray valve manifold 126 as best seen in FIG. 3. In order to maximize the efficiency of spraying the sheet material 228 and thereby minimizing waste of the liquid lubrication compound, spray control valves 124(*a*)–(*i*) will be selectively opened depending on the width of the sheet material 228 that is either automatically determined on the coating line 234 or manually input by the user at the Setup Screen as previously described. Referring to FIG. 3, the following valves are selectively opened to provide adequate coating to a sheet 228 based on standard sheet metal roll widths noted below.

Sheet material 228 in a 24 inch width: open spray control valves 124(*g*)–(*i*);

Sheet material 228 in a 34 or 40 inch width: open spray control valves 124(*e*)–(*i*);

Sheet material 228 in a 48 inch width: open spray control valves 124(*c*)–(*i*); and Sheet material 228 in a 62 or 72 inch width: open spray control valves 124(*a*)–(*i*).

Referring to FIGS. 3–5, each spray control valve 124 through spray manifold 170 provides liquid lubrication compound to two spray nozzles 184, one nozzle on upper beam 162 and one nozzle on lower beam 164. For example, for sheet material 228 in a 24 inch width, three spray control valves are opened providing liquid lubrication compound to a total of six spray nozzles 184, three spray nozzles on the upper beam 162 and three nozzles to the lower beam 164.

In order to provide or support the required spray nozzles 184 to apply the desired coating weight, the process tank valve 98 is opened and adjusted to a position to provide the necessary volume of liquid lubrication compound to the spray control valves. As explained above, the proper volume of liquid lubrication compound depends on the width of sheet material 228, the linear speed sheet metal 228 is traveling along the coating line 234, and the desired coating weight. To achieve active monitoring of the flow and pressure of liquid lubrication compound in spray valve inlet line 136, a flow sensor 138 and pressure sensor 140 are positioned in line 136 as seen in FIG. 2. Signals from sensors 136 and 138 to control terminal 22 through control signal input 23 and output 24 lines are compared against acceptable figures stored in user terminal 22 software and the flow of liquid lubrication compound is adjusted through valve 98 to maintain acceptable volume passing to the spray control valves 124.

On passage of the liquid lubrication compound through the selected spray control valves 124, the liquid lubrication compound passes to the spray manifold 170 and into fluid inlet receptacles 176 depending on which spray control valves 124 are open. For each control valve outlet line 144 providing fluid to a particular fluid inlet receptacle 176, the fluid is divided in manifold 170 to provide fluid to two nozzles 184, one nozzle on the upper beam 162 and one nozzle on the lower beam 164. Manifold fluid outlet lines 178 provide the liquid lubrication compound for the particular control valves to the respective spray nozzles 184.

Simultaneously, a heated gas, most preferably steam, under pressure from steam line 36 is provided to the spray manifold 170 and into steam inlet receptacles 172 as shown in FIG. 5. Steam will be supplied to all 18 of the nozzles 184 compared with only the selected nozzles 184 receiving liquid lubrication compound. Supply of steam to all of the nozzles aids in the atomization of the liquid lubrication compound sprayed from the activated nozzles 184 and aids in controlling and confining the spray pattern to the desired area. To initiate supply of steam to manifold 170 and spray nozzles 184, user control terminal 22 opens the pneumatically operated steam control valve 218 as best seen in FIG. 2. To monitor and control the flow and pressure of steam provided to spray header 150 in a similar fashion to liquid lubrication compound to the spray control valves 124, a steam flow sensor 222 and pressure sensor 226 are positioned along spray header steam line 220 and along with user control monitor 22, steam control valve 218 is adjusted to ensure an adequate supply of steam is available to support spray header 150. In an alternate aspect, heated air may be used instead of steam as the heated gas.

Referring to FIGS. 4, 6 and 8, as described above, most preferably nine nozzles 184 are placed in spaced relationship to one another on the upper beam 162 and nine nozzles 184 on the lower beam 164 as best seen in FIGS. 5 and 6. Each nozzle 184 is adapted to receive a single and dedicated liquid lubrication outlet line 178 from manifold 170 and a single, dedicated steam outlet line 174 from manifold 170. Each nozzle 184 is adapted to place the in-flowing liquid lubrication compound under pressure and incoming steam under pressure in direct fluid and gaseous communication with one another to further heat and atomize the liquid lubrication compound. Through a spray aperture in each of nozzles 184, atomized spray coating 200 having a width of spray 202 and length of spray 204 is produced as best seen in FIGS. 4 and 8. The heated and atomized spray 200 is directed toward the adjacent upper or lower surface of sheet material 228 to completely coat the material sheet with the desired weight of coating. Spray 200 has a width 202 of approximately 9 inches when the depth of spray 204 is approximately 7½ inches. In a preferred aspect of the invention, the distance 256 between opposing nozzles 184 on upper beam 162 and lower beam 164 is approximately 15⅛ inches as seen in FIG. 4.

Referring to FIGS. 4 and 8, each nozzle 184 preferably includes a nozzle jacket 188 which is adapted to receive an independent supply of a heated gas, most preferably steam, to the nozzle jacket 188 for the purpose of heating the nozzle 184 and further deterring clogging of the nozzle 184. Steam is supplied to the nozzle jackets 188 from steam line 36 through spray header steam line 220 which supplies manifold 170 with steam in receptacle 192 as seen in FIG. 5. Manifold 170 provides two steam outlet lines 194, one for passage of steam to the nozzle jackets 188 on upper beam 162 and one line 194 to the nozzle jackets 188 on lower beam 164 as best seen in FIGS. 4, 5 and 6. Only one steam outlet line 194 is used to service all of the nozzle jackets 188 on the upper beam 162 and one line 194 to service all of the nozzle jackets 188 on the lower beam 164 as best seen in FIGS. 4 and 6. A suitable connection of steam lines 194 to spray header 150 is shown through section A—A taken from FIG. 4 as shown in FIG. 7. In an alternate aspect, heated air is used instead of steam for the heated gas.

Control of pressurized steam to the nozzle jackets 188 as described is controlled by user control terminal 22 which, when spray control valves 124 are open and providing liquid lubrication compound to the spray header 150, steam flow control valve 218 is equally opened providing steam to atomize the liquid lubrication compound and simultaneously, providing steam to the nozzle jackets 188 as described. The total flow and pressure of steam provided to atomize the liquid lubrication compound and supplied to the nozzle jackets 188 is monitored by steam flow sensor 222 and pressure sensor 226 as previously described.

In operation, the atomized lubrication compound 200 is applied to both upper and lower surfaces of sheet material 228 to completely coat the sheet material with the desired weight of coating. The heating and atomizing of the liquid lubrication compound provides a very consistent coating of sheet material 228 without the use of secondary rollers to squeeze or press excess coating from sheet material 228. Through selective use of spray nozzles 184 tailored to the width of material sheet 228, a significant reduction in the amount of spray lubricant that is wasted is achieved.

On reaching the trailing end of sheet material 228 traveling along coating line 234, or when the level of liquid lubrication compound and process tank 62 reaches the predetermined lower liquid level of 45 gallons, spraying of the material sheet is halted. Cessation of spraying may be achieved automatically by sensors, not shown, detecting the end of the sheet 228 or manually through a button or prompt on the user interface. Regarding the former occurrence, if it is anticipated that a short time period will lapse until spraying is recommenced, process mixing assembly 60 will be placed in a recirculation mode by closing a process solenoid control valve 112 thereby circulating the liquid lubrication compound in recirculation line 76 by process pump 74 as previously described. If a longer period is anticipated, the path of the liquid lubrication compound downstream of process solenoid valve 112 is flushed with a heated gas, most preferably steam, or in an alternate aspect heated air, as previously described. This is achieved by the user control terminal 22 opening steam flow control valve 218 which, as described, provides pressurized steam to the spray control valves 124, manifold 170, nozzles 184 and nozzle jackets 188 to flush the system of any lubricant residue. This flushing takes place for approximately 15 minutes.

Where the level of liquid lubrication compound in process tank 62 reaches the predetermined lower liquid level line of 45 gallons as monitored by process tank level sensor 68, transfer of a pre-prepared, heated and mixed batch of liquid lubrication compound in batch tank 14 may be simultaneously transferred to the process tank 62 as previously described providing for a continuous flow of liquid lubrication compound to spray header 150 without stopping the coating line 234.

The atomization of the heated liquid lubrication compound through spray 200 provides for quick evaporation of the water in the atomized spray 200 providing for rapid drying of the sprayed-on lubricant on sheet material 228. Advantages of fast drying the lubricant are two-fold. First, higher line speeds may be used. Second, it greatly reduces the distance required for drying along the coating line 234 once the sheet material passes through spray header 150. The length required for drying of the sheet material under the present inventive method is up to 90% less than prior art processes. Due to the reduction of space required for drying along the process line and relatively small space required for the spray header 150 along the process line, coating apparatus 10 may be readily installed and positioned to suit the demanding needs of the coating facility.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method of spray coating a sheet material traveling along a coating line, the method comprising the steps of:

adding a water soluble material with a quantity of water in a batch tank;

mixing the water soluble material with water in the batch tank to form a liquid compound;

selectively dispensing the liquid compound from the batch tank to at least one spray nozzle in fluid communication with the batch tank;

atomizing the liquid compound; and spraying the atomized liquid compound from the nozzle onto the sheet material.

2. The method of claim 1 further comprising the step of heating the liquid compound in the batch tank.

3. The method of claim 1 further comprising the step of selectively dispensing the liquid compound from the batch tank to a process tank in fluid communication with the batch tank prior to dispensing the liquid compound to the spray nozzle.

4. The method of claim 1 further comprising the step of providing a heated gas to the spray nozzle in gaseous communication with the liquid compound.

5. The method of claim 4 wherein the heated gas is steam.

6. The method of claim 4 wherein the heated gas is air.

7. The method of claim 1 further comprising the step of providing a heated gas to a jacket of the spray nozzle to heat the nozzle and deter clogging of the nozzle.

8. The method of claim 1 wherein the water soluble material is a dry lubricant for sheet metal.

9. A method of applying a dry lubricant to sheet metal traveling along a coating line, the method comprising the steps of:

adding a water soluble dry lubricant with a quantity of water in a batch tank;

mixing the dry lubricant with water in the batch tank to form a liquid lubrication compound;

selectively dispensing the liquid lubrication compound from the batch tank to a plurality of spray nozzles in fluid communication with the batch tank;

providing steam to the spray nozzles;

communicating the liquid lubrication compound with the steam to heat and begin atomizing the liquid lubrication compound; and spraying the atomized lubrication compound from the nozzles onto the sheet metal.

10. The method of claim 9 further comprising the step of heating the water prior to adding the dry lubricant.

11. The method of claim 10 wherein the water is heated to approximately 180° Fahrenheit.

12. The method of claim 9 further comprising the step of recirculating the liquid lubrication compound through the batch tank when not dispensing the liquid lubrication compound from the batch tank to deter sedimentation of the liquid lubrication compound.

13. The method of claim 9 further comprising the step of selectively dispensing the liquid lubrication compound from the batch tank to a process tank positioned between and in fluid communication with the batch tank and the spray nozzles.

14. The method of claim 9 further comprising the step of dispensing the liquid lubrication compound from the batch tank to a plurality of spray control valves to selectively control the dispensing of the liquid lubrication compound to the spray nozzles.

15. The method of claim 14 further comprising the step of selectively activating at least one of the plurality of spray control valves to provide the liquid lubrication compound to at least one of the plurality of spray nozzles in fluid communication with the activated spray control valves.

16. The method of claim 9 further comprising the step of providing steam under pressure to a jacket of each of the spray nozzles to heat the nozzles and deter clogging of the nozzles.

17. The method of claim 9 further comprising the step of adjusting the dispensing of the liquid lubrication compound from the batch tank to provide a sufficient volume of the liquid lubrication compound to the spray nozzles to adequately coat the sheet metal.

18. The method of claim 9 further comprising the step of controlling the mixing of the water soluble lubricant and the dispensing of the liquid lubrication compound through a user control terminal.

19. The method of claim 9 wherein the dry lubricant is a borax-based lubricant.

20. The method of claim 9 further comprising the step of flushing a path of travel of the liquid lubrication compound between the batch tank and the spray nozzles to clean the path of the liquid lubrication compound and deter clogging.

21. A sheet material coating apparatus for spraying an atomized liquid compound onto a sheet material traveling along a coating line, the apparatus comprising:

a batch tank having a mixer for containing and mixing the liquid compound;

at least one spray control valve in fluid communication with the batch tank for selectively dispensing the liquid compound from the batch tank; and at least one spray nozzle in fluid communication with the spray control valve, wherein the spray nozzle is adapted to receive and communicate both the liquid compound and a heated gas to heat and begin atomizing the liquid compound and spray the atomized liquid compound onto the sheet material.

22. The apparatus of claim 21 further comprising a process tank positioned in fluid communication with the batch tank and the spray control valve to store a reserve of the liquid compound until dispensed.

23. The apparatus of claim 21 further comprising a user control terminal for monitoring and controlling the mixing of the liquid compound and the spraying of the atomized liquid compound.

24. The apparatus of claim 21 further comprising a base supporting the batch tank and the spray control valve.

25. The apparatus of claim 21 wherein the batch tank further includes a heating coil for heating the liquid compound.

26. A sheet material coating apparatus for mixing a dry sheet metal forming lubricant with water to form a liquid lubrication compound, atomizing the liquid lubrication compound with steam and spraying the atomized lubrication compound onto sheet metal traveling along a coating line, the apparatus comprising:

a base;

a batch tank positioned on the base for mixing and holding the liquid lubrication compound;

a process tank positioned on the base in fluid communication with the batch tank for holding a reserve of the liquid lubrication compound;

a plurality of spray control valves in fluid communication with the process tank to selectively dispense the liquid lubrication compound from the process tank; and a spray header positioned along the coating line in spaced relationship from the base in fluid communication with the spray control valves, the spray header having a plurality of spray nozzles in spaced relation to one another in fluid communication with the spray control valves, the spray nozzles are adapted to receive and communicate the liquid lubrication compound and the steam under pressure with one another to heat, atomize and spray the sheet metal.

27. The apparatus of claim 26 wherein at least one of the batch tank and the process tank further comprises a heating element for heating the liquid lubrication compound in the tank.

28. The apparatus of claim 26 wherein each of the spray nozzles further comprise a nozzle jacket adapted to receive steam to heat and deter clogging of the nozzle.

29. The apparatus of claim 26 wherein the spray header further comprises an upper header positioned above the sheet metal and a lower header positioned below the sheet metal, each header adapted to receive at least one of the plurality of spray nozzles.

30. The apparatus of claim 26 further comprising at least one pump to provide the liquid lubrication compound to the spray control valves under pressure.

31. The apparatus of claim 26 further comprising a user control terminal for monitoring and controlling the mixing of the liquid lubrication compound and spraying of the atomized lubrication compound.

32. An apparatus for applying a spray coating to sheet material traveling along a coating line, the apparatus comprising:

means for adding a water soluble material with a quantity of water in a batch tank;

means for mixing the material with water in the batch tank to form a liquid compound;

means for selectively dispensing the liquid compound from the batch tank under pressure to at least one spray nozzle in fluid communication with the batch tank;

means for atomizing the liquid compound; and means for spraying the atomized liquid compound from the nozzle onto the sheet material.

* * * * *